US006596353B1

(12) United States Patent
Turner

(10) Patent No.: US 6,596,353 B1
(45) Date of Patent: Jul. 22, 2003

(54) ARTIFICIAL PALM TREE

(76) Inventor: Wendell G. Turner, 12631 SW. Frontier Trail, Andover, KS (US) 67002

( * ) Notice: Subject to any disclaimer, the term of this patent is extended or adjusted under 35 U.S.C. 154(b) by 0 days.

(21) Appl. No.: 10/170,334

(22) Filed: Jun. 12, 2002

(51) Int. Cl.[7] ..... A41G 1/00

(52) U.S. Cl. ..... 428/18; 428/17; 428/27; 52/40; 248/682; 248/49; 248/156

(58) Field of Search ..... 428/17, 18, 27; 52/40, 3; 211/181.1; 248/49; D11/118

(56) References Cited

U.S. PATENT DOCUMENTS 2,251,705 A * 8/1941 Gonzalez ..... 62/281
5,085,900 A * 2/1992 Hamlett ..... 428/18
5,340,622 A 8/1994 Curitti
6,089,658 A * 7/2000 Law ..... 297/219.1
6,286,266 B1 9/2001 Popowych et al.
6,343,440 B1 2/2002 Ayers

* cited by examiner

*Primary Examiner*—Deborah Jones
*Assistant Examiner*—Arden Sperty
(74) *Attorney, Agent, or Firm*—Kenneth H. Jack; Davis & Jack, LLC

(57) ABSTRACT

An artificial palm tree having a base, a frame fixedly attached to and extending upwardly from the base, the frame having an upper end; a helically wound metal strap having a leaf scar indicating edge, a multiplicity of heat fusion welds interconnecting the frame mounting edge of the helically wound metal strap and the frame; twelve rachis indicating shafts; a concentrically mounted cylinder slip sleeve and slip pin joint interconnecting the proximal ends of the rachis indicating shafts with the upper end of the frame; and a multiplicity of pinna indicating plates fixedly attached to the rachis indicating shafts.

11 Claims, 6 Drawing Sheets

ARTIFICIAL PALM TREE

FIELD OF THE INVENTION

This invention relates to metal fabricated structures adapted for portraying or indicating an appearance of a natural palm tree.

BACKGROUND OF THE INVENTION

Natural palm trees are known to be placed or grown for decorative purposes within outdoor courtyards, pool side areas, common halls of commercial buildings, and residential living areas. Such placement desirably promotes a tropical or seashore ambience within such spaces. Natural palm trees are often difficult to grow and maintain within enclosed structures, and natural palm trees are often impossible to grow and maintain out of doors in northern climates. Known artificial palm tree structures promote a tropical or seashore ambience without incurring the growth, plant health and environmental control difficulties associated with natural palm trees. However, artificial palm trees are typically difficultly and expensively constructed, lack durability, and often ineffectively portray or indicate the appearance of a natural palm tree.

The instant inventive artificial palm tree overcomes the above noted defects and deficiencies by providing a metal trunk frame, helically wound metal skin, and pinnate palm leaf plate assembly which promotes economies in construction time and labor, which promotes cost economies, and which effectively promotes and conveys a natural palm tree appearance.

BRIEF SUMMARY OF THE INVENTION

The instant inventive artificial palm tree is necessarily mounted upon and extends upwardly from a base. Preferably, the base comprises a ⅜" inch thick steel plate having rectangular dimensions of approximately eighteen inches by twenty-six inches. Preferably, the base has a centrally located spindle receiving aperture therethrough, and has a plurality of, preferably four, mounting lug or bolt receiving apertures which are peripherally located near the four corners of the base. The spindle receiving aperture beneficially facilitates rotary movement of the trunk frame during fabrication, and the mounting lug apertures facilitates attachment of the base to a concrete slab or wooden deck surface.

The upper surface of the base preferably includes four bar receiving recesses preferably arranged radially in a square pattern around the spindle receiving aperture. The diagonal distance between the bar receiving recesses preferably approximates the diameter of the lower end of the trunk of the inventive artificial palm tree. Suitably, the base may be differently shaped and may comprise a rigid material other than steel.

Four lengths of steel bar stock, preferably having diameters between ⅝" and ¾", are butt joint welded at their lower ends to the preferred steel base so that each metal bar extends longitudinally upward from one of the four bar receiving recesses. The recesses facilitate welding of the butt joints where the fabricator chooses to extend the bars upwardly at an angle other than 90°, in the manner of natural growing palm trees. Each such longitudinally extending bar has a length approximating the desired overall length of the trunk of the artificial palm tree, and each of such bars is preferably arcuately curved in a manner reflecting a natural curvature of a trunk of a natural palm tree. Preferably, the longitudinally extending bars are substantially identically bent to assume the desired curvature prior to welding to the base.

The preferred four longitudinally extending bars comprise major structural elements of an internal trunk frame. Suitably, a greater or lesser number of longitudinally extending bars may be utilized in the construction of the trunk frame member. Preferably, welded cross braces span between the longitudinally extending bars, such cross braces providing rigidity and structural strength to the frame. Preferably, the cross braces have centrally welded "X" configurations, and preferably such braces are spaced at approximate two feet intervals, having progressively shorter dimensions defining a natural upward taper. Suitably, though less desirably, the frame may comprise wood. Also suitably, though less desirably, the frame may be configured as a tapered tube.

The upper end of the trunk frame necessarily comprises rachis mounting means adapted to support and retrain a palm tree crown indicating structure. More particularly, the rachis mounting means is preferably adapted for facilitating fixed and removable attachments of distal ends of a plurality of leaf rachis portraying or indicating shafts. A preferred slip sleeve and slip pin rachis mounting means comprises concentrically mounted inner, medial, and outer sleeves, such sleeves being spaced with respect to each other so that their inner and outer surfaces form and define slip sleeve channels fitted for nestingly receiving and retaining the distal ends of the rachis indicating shafts, such ends functioning as slip pins. Preferably, such cylinders comprise approximate seven inch lengths of square tubing which are interconnected by welded attachments to a common floor. Suitably, other rachis mounting means comprising mounting surfaces mechanically combined with heat fusion welds, adhesive bonds, spirally threaded lug and aperture combinations, rivets, screws, staples, or spirally threaded nut and bolt combinations may be utilized.

The preferred upper crown indicating element of the inventive artificial palm tree preferably comprises nine to twelve of such metal rachis indicating shafts, each such shaft preferably comprising a flat metal bar bent in the manner of the natural curvature of a pinnate palm tree leaf.

A multiplicity of metal plates, each individually shaped to suggest or indicate the leaflet or pinna of a natural palm leaf, are necessarily attached to or wholly formed as a part of the rachis indicating shafts, such pinna indicating plates being oriented and arranged thereon in a manner similar to the arrangement of natural palm leaf pinna. Preferably, the multiplicity of pinna indicating plates are fabricated from sheet metal such as sheet steel, sheet aluminum or sheet copper, and preferably a plasma jet torch is utilized for quickly and efficiently cutting the pinna plate outlines. The pinna indicating plates are preferably fixedly attached to the rachis indicating shafts by heat fusion welds. Other suitable pinna indicating plate attaching means comprise slip pin and slip sleeve combinations, spirally threaded lug and aperture attachments, whole formed joints, adhesive bonds, rivets, screws, staples, and spirally threaded nut and bolt combinations.

A skin element of the inventive artificial palm tree necessarily comprises an overlapping helically wound metal strap extending from the upper end of the frame of the artificial palm tree to the frame's lower end. The exposed edge of such strap functions to portray or indicate circular leaf scarring which is common to trunks of natural palm trees. For ease of handling upon fabrication, the metal strap is preferably longitudinally segmented, each segment being between five and ten feet in length. Preferably, the strap has a vertical dimension between two and three inches. The strap preferably comprises galvanized steel, mild steel, stainless steel, copper, brass, aluminum, bronze, nickel, various metal alloys, or alternating combinations of such metals.

The preferred thickness of the metal strap is between 0.016 inches and 0.040 inches. Preferably, the exposed edges of the strap are inturned or inwardly flanged, the inturned character of the exposed edges preferably being fabricated by means of a metal melting cutting process which extends a molten bead of metal inwardly. Preferably, plasma jet torch cutting is performed. Suitably, though less desirably, oxyacetylene torch cutting may be utilized. The inturned character of the exposed leaf scar indicating edge of the metal strap beneficially eliminates sharp exposed edges upon the trunk surface. Preferably, the exposed edge of the strap is cut in a wavering or undulating manner, causing such edge to better portray or indicate circular palm tree trunk scarring. Preferably, the metal strap is wrapped helically from the upper end of the trunk downwardly to its base, forming an inverted clinker-built or lap jointed surface, such inverted overlapped configuration being common to the upward and outward growth of natural palm tree trunks. Suitably, though less desirably, upward wrapping from the base may be utilized.

Where the upper edge of the metal strap serves as the leaf scar indicating edge, the lower edge of the strap is preferably spot welded at its points of contact with the underlying frame. Other strap mounting means which may be suitably utilized comprise screws, rivets, nails, blind fasteners, staples, and spirally threaded nut and bolt combinations.

Accordingly, it is an object of the present invention to provide a structure adapted for mechanical simplicity and for economically indicating or portraying the appearance of natural palm tree, such structure incorporating an internal metal frame supporting a skin element comprising a helically wound metal strap.

It is a further object of the present invention to provide such a structure further incorporating rachis attaching means comprising concentrically mounted cylinders forming concentrically arranged slip sleeve joints.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
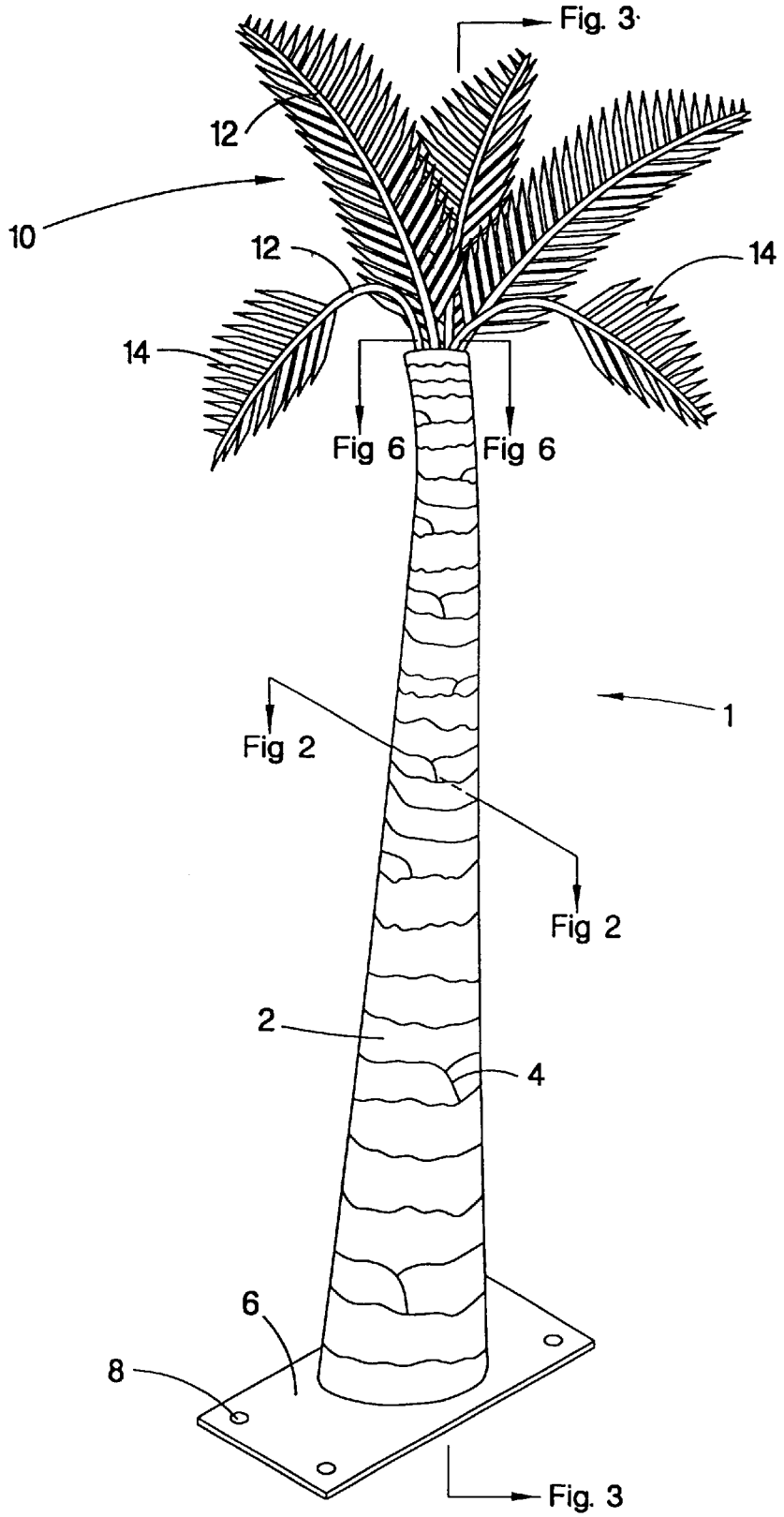
FIG. 1 is an isometric view of the instant inventive artificial palm tree.

Referring now to the drawings, and in particular to FIG. 1, the instant inventive artificial palm tree is referred to generally by Reference Arrow 1. The artificial palm tree 1 has a rectangular base 6, the rectangular base 6 preferably having four mounting apertures 8. The mounting apertures 8 are utilizable for fixedly mounting the artificial palm tree 1 over spirally threaded lugs (not depicted) extending upwardly from a concrete slab, (not depicted) or said apertures may be utilized for receiving lag screws or bolts (not depicted) for mounting the artificial palm tree 1 upon a wooden deck surface (not depicted).

Figure 2:
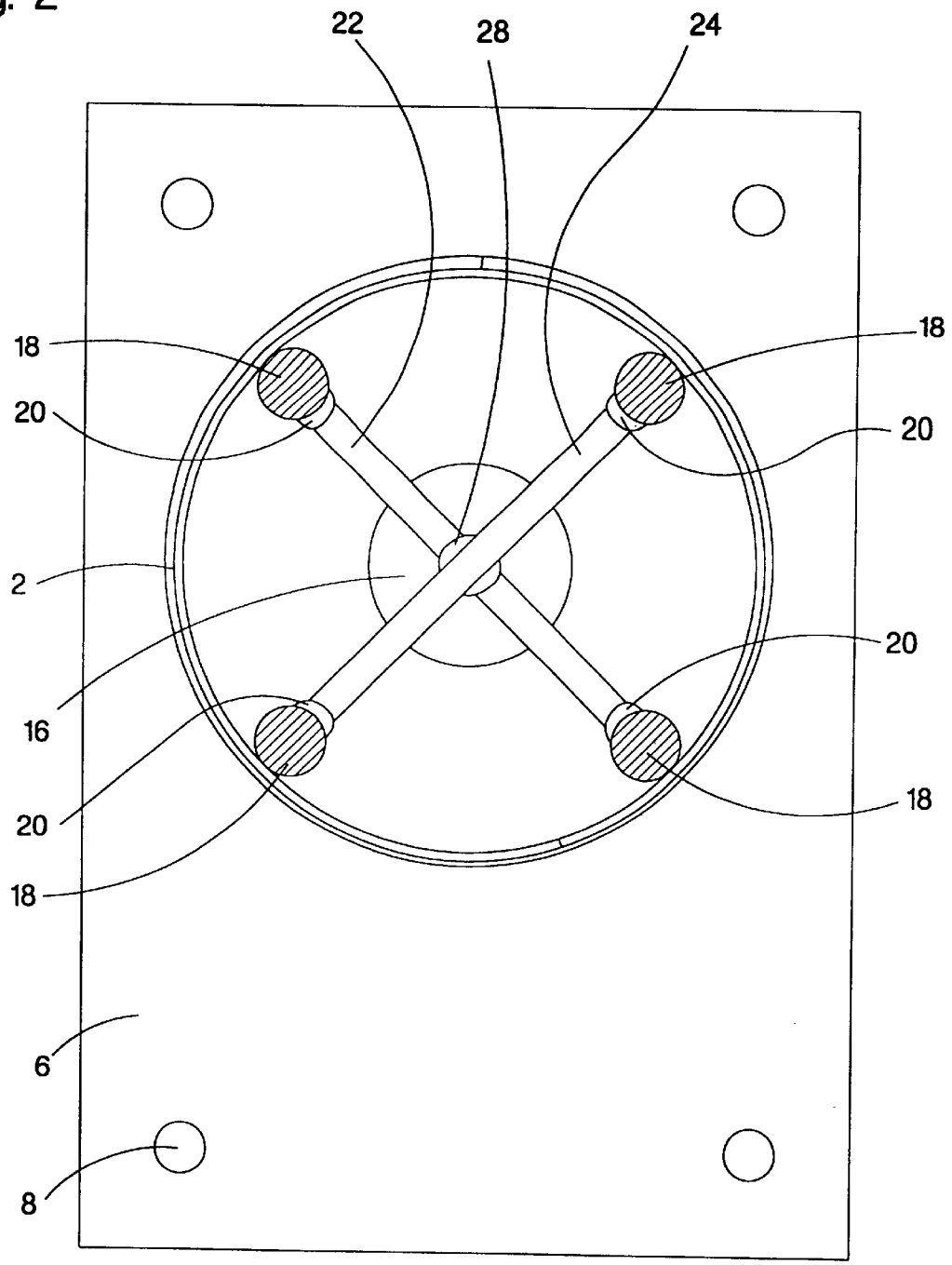
FIG. 2 is a sectional view as indicated in FIG. 1.

Referring to FIG. 2, the base plate 6 preferably further has a spindle receiving aperture 16, such aperture beneficially facilitating rotating movement of the trunk of the Artificial Palm Tree during fabrication.

Figure 3:
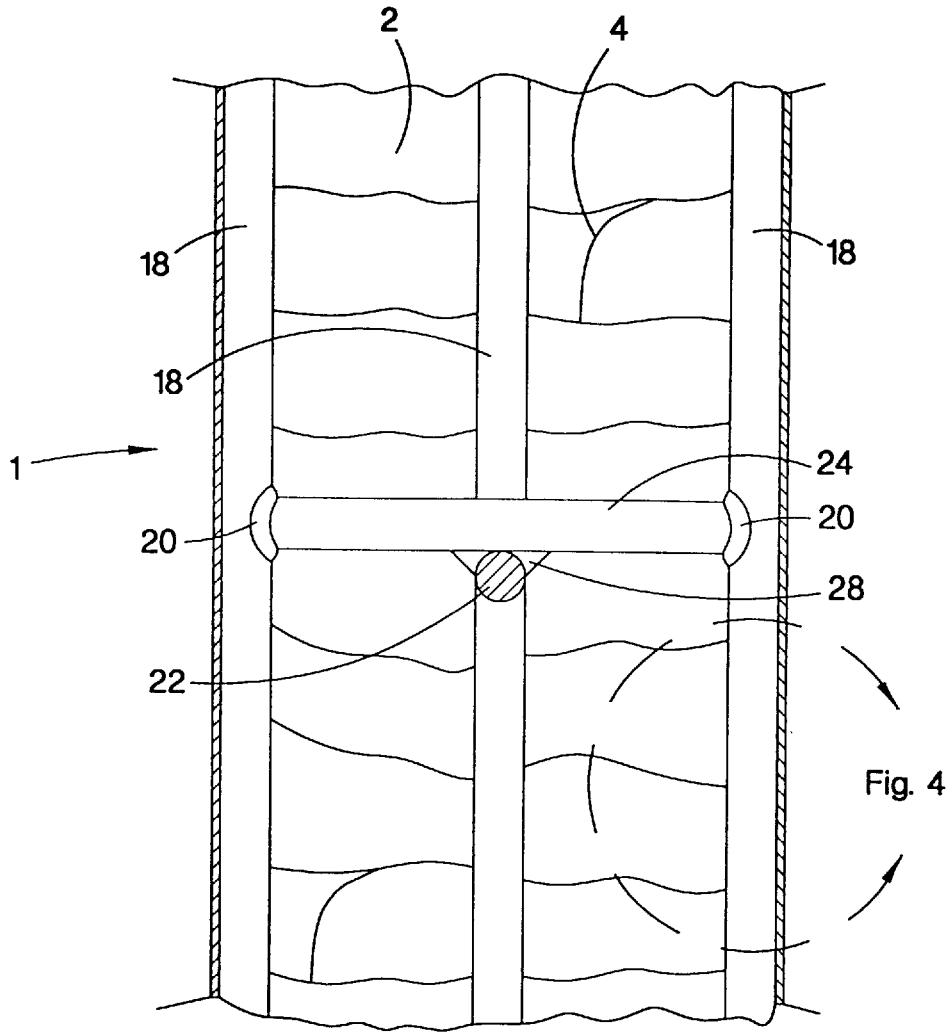
FIG. 3 is a sectional view as indicated in FIG. 1.

Referring simultaneously to FIGS. 1–3, lower ends of four longitudinally extending metal bars 18 are preferably welded to recesses (not depicted) which are drilled within the upper surface of plate 6. Metal bars 18 preferably are pre-bent to match the desired curvature of the trunk of the artificial palm tree 1.

Referring simultaneously to FIGS. 2 and 3, the four longitudinally extending bars 18 preferably have cross-bracings 22 and 24 spaced at approximate two foot intervals, such cross-bracings being attached to bars 18 and centrally to themselves by welds 20 and 28.

Figure 6:
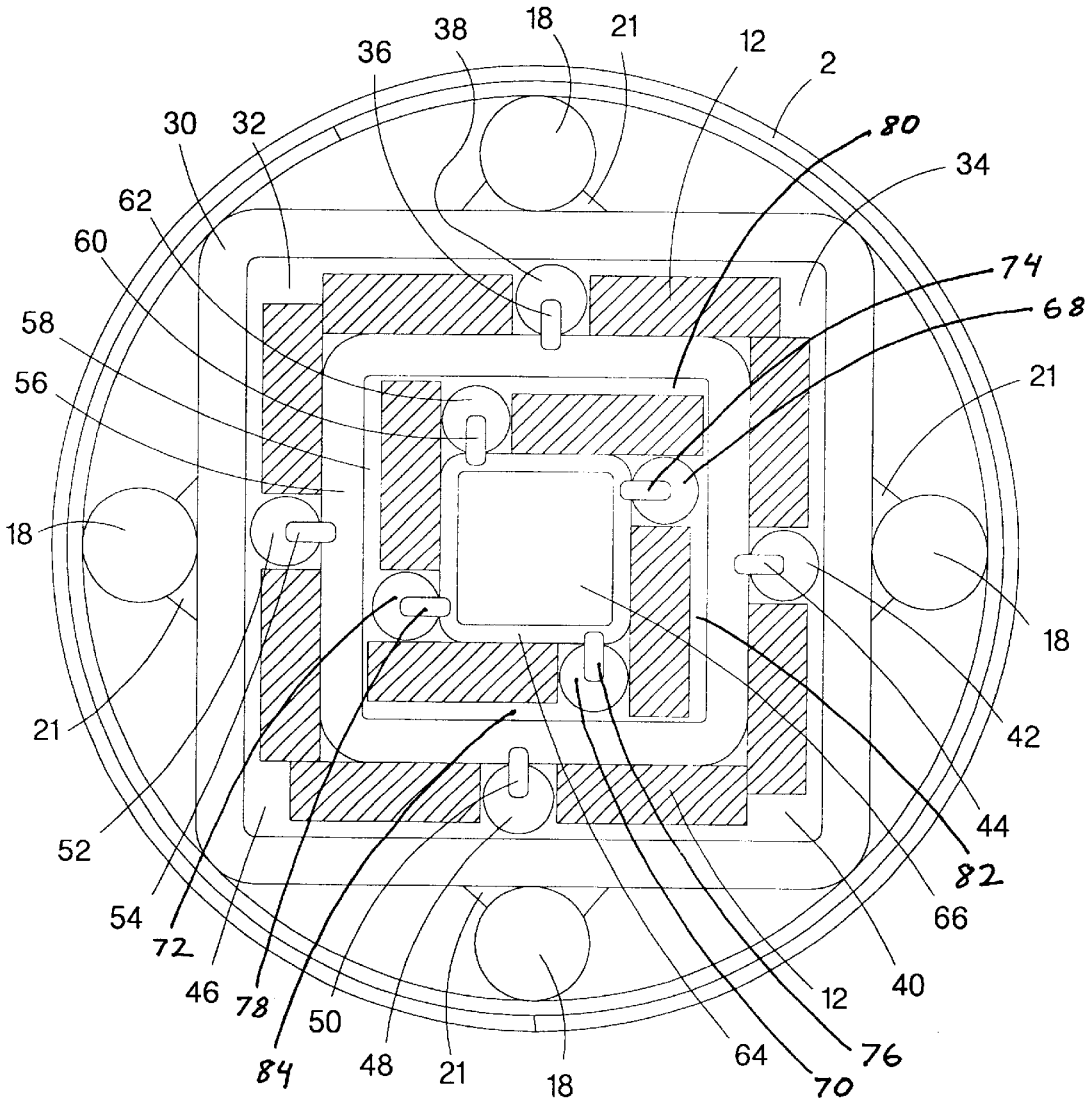
FIG. 6 is a sectional view as indicated in FIG. 1.

Referring to FIG. 6, the upper ends of metal bars 18 are preferably fixedly attached to the outer surface of a length of square tubing 30 by means of heat fusion welds 21. Preferably, the outer length of square tubing segment 30 has a vertical dimension of approximately seven inches, and preferably a square floor plate 66 spans across and is fixedly welded to tube 30's lower end. The square tube 30 in combination with floor plate 66 serves dual functions of providing structural cross-bracing for the upper end of the artificial palm tree trunk's frame and, referring to FIG. 1, providing means for attaching and mounting the crown 10 of the artificial palm tree 1. Such attaching means function is facilitated by welded attachments to the floor plate 66 of an inner length of square tubing 64 and a medial length of square tubing 56.

Vertically extending partitioning bars 62, 68, 70, and 72 are preferably fixedly welded to the outer surface of inner tube 64 by welds 60, 74, 76, and 78; and vertically extending partitioning bars 38, 42, 48, and 52 are preferably similarly fixedly welded to the outer surface of medial tube 56 by means of welds 36, 44, 50, and 54. Said tubes 30, 56 & 64, in combination with said eight vertically extending partitioning bars form a plurality of rachis receiving spaces 32, 34, 40, 46, 58, 80, 82, and 84. Such spaces advantageously function as a preferred slip sleeve rachis attaching means.

Referring simultaneously to FIGS. 1 and 6, the crown 10 of the inventive artificial palm tree 1 preferably comprises twelve structures portraying or indicating common pinnate palm tree leaves having curved rachis of leaf stem indicating shafts 12, and having a multiplicity of leaflets or pinna indicating plates 14 fixedly welded to the rachis indicating shafts 12. The distal ends of the rachis indicating shafts 12 are securely slidably received within said slip sleeve spaces 32, 34, 40, 46, 58, 80, 82, and 84 defined by the concentrically mounted tubes 30, 56, and 64, and by the eight vertically extending partitioning bars 38, 42, 48, 52, 62, 68, 70, and 72.

Figure 4:
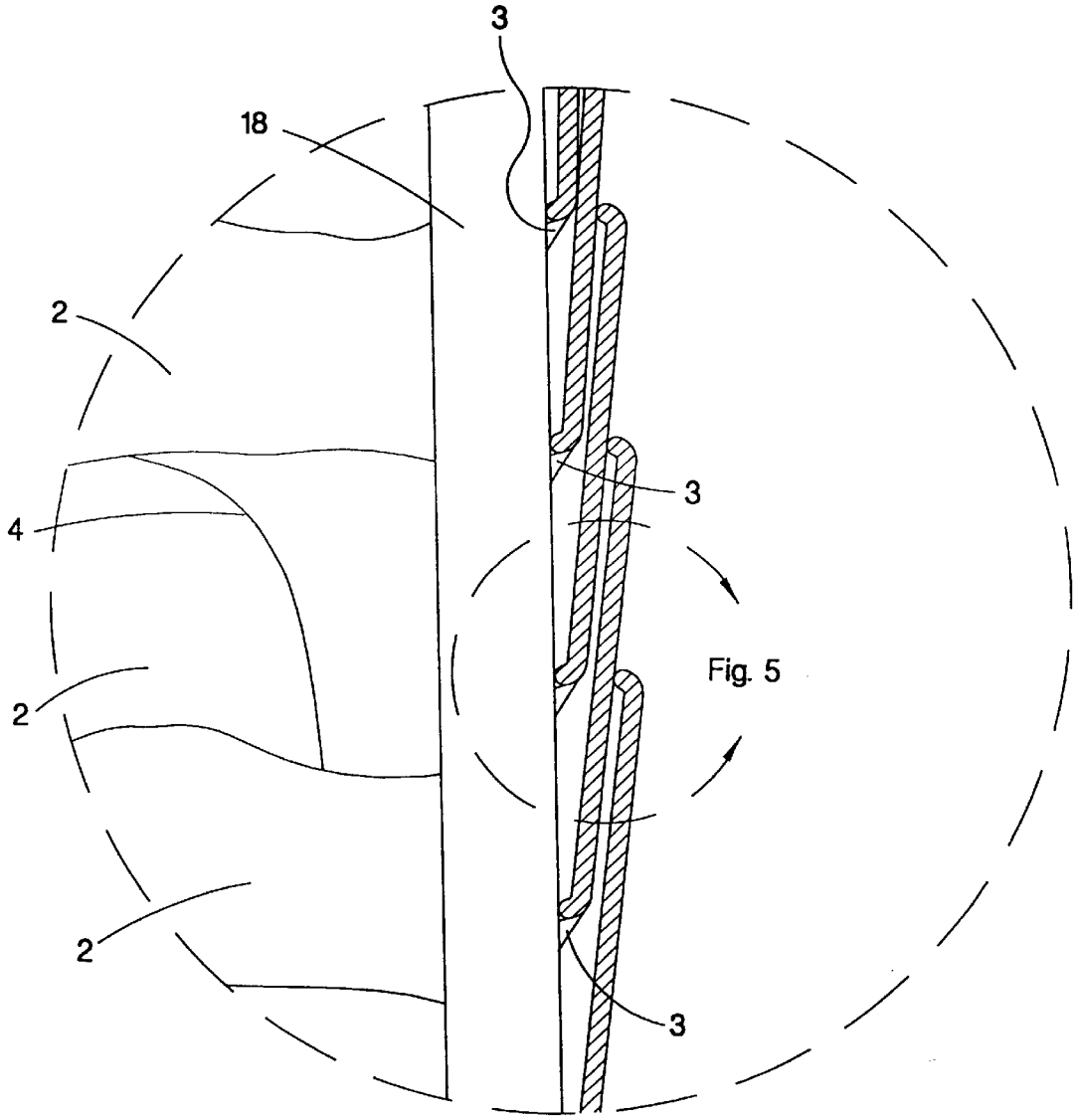
FIG. 4 is a magnified view as indicated in FIG. 3.
Figure 5:
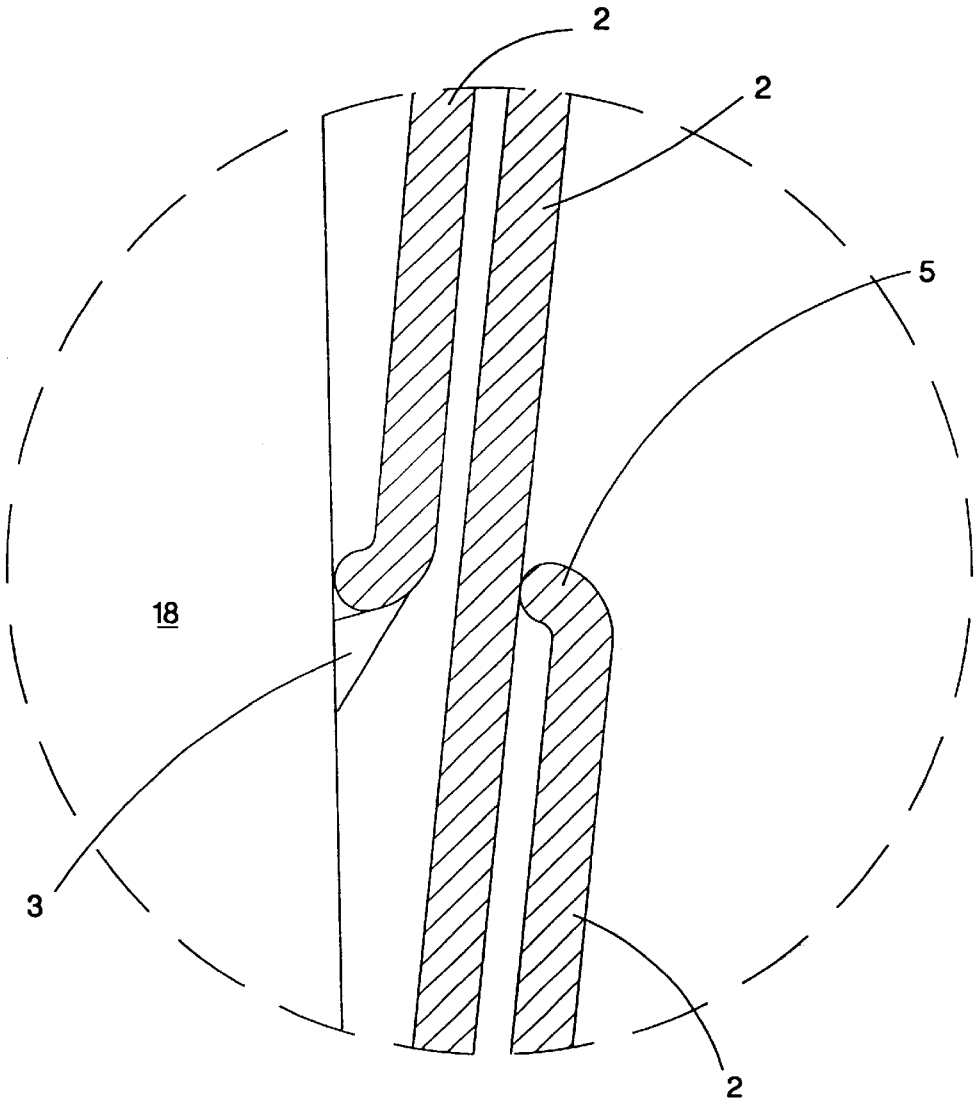
FIG. 5 is a magnified view as indicated in FIG. 4.

Referring simultaneously to FIGS. 3–5, the trunk skin of the inventive artificial palm tree 1, preferably comprises a multiplicity of helically wound overlapping oblong metal straps 2, each oblong metal strap 2 having a naturally undulating or waving leaf scar indicating edge, and having arcuately curved ends 4. The straps 2 are preferably fixedly attached in such helically wound fashion to the longitudinally extending bars 18 by welds 3. Preferably, the straps 2 are cut from sheet metal by means of plasma jet torch cutting, such means beneficially forming inturned melt formed edges 5, such edges 5 preventing the outer surfaces of the inventive Artificial Palm Tree from presenting undesirable sharp edges.

While the principles of the invention have been made clear in the above illustrative embodiment and in the above invention summary, those skilled in the art may make modifications in the structure, arrangement, portions and components of the invention without departing from those principles. Accordingly, it is intended that the invention summary, the description, and the drawings be interpreted as illustrative only, and not in the limiting sense, and that the invention be recognized as having a scope commensurate with the appended claims.

I claim:

1. An artificial palm tree comprising:

(a) a base;

(b) a frame fixedly attached to and extending upwardly from the base, the frame having an upper end;

(c) a helically wound metal strap having a leaf scar indicating edge;

(j) strap mounting means interconnecting the helically wound strap and the frame;

(k) a plurality of rachis indicating shafts, each rachis indicating shaft having a proximal end;

(l) rachis mounting means interconnecting the proximal ends of the rachis indicating shafts, and the upper end of the frame;

(m) a multiplicity of pinna indicating plates; and, (n) pinna mounting means interconnecting the pinna indicating plates and the rachis indicating shafts, the strap mounting means comprising a fastener selected from the group consisting of heat fusion welds, screws, rivets, nails, blind fasteners, staples, spirally threaded nut and bolt combinations, and adhesive bonds, the frame comprising a plurality of longitudinally extending shafts, and a plurality of laterally extending braces, the laterally extending braces spanning between and interconnecting the longitudinally extending shafts.

2. The artificial palm tree of claim 1 wherein the helically wound metal strap comprises a plurality of strap segments.

3. The artificial palm tree of claim 2 wherein the rachis mounting means comprises a fastener selected from the group consisting of slip sleeve and slip pin joints, spirally threaded lug and aperture combinations, heat fusion welds, adhesive bonds, rivets, screws, and spirally threaded nut and bolt combinations.

4. The artificial palm tree of claim 3 wherein the pinna mounting means comprises a fastener selected from the group consisting of heat fusion welds, slip sleeve and slip pin combinations, spirally threaded lug and aperture combinations, whole formed joints, adhesive bonds, rivets, screws, staples, and spirally threaded nut and bolt combinations.

5. An artificial palm tree comprising:

(a) a base;

(b) a frame fixedly attached to and extending upwardly from the base, the frame having an upper end;

(c) a helically wound metal strap having a leaf scar indicating edge;

(o) strap mounting means interconnecting the helically wound strap and the frame;

(p) a plurality of rachis indicating shafts, each rachis indicating shaft having a proximal end;

(q) rachis mounting means interconnecting the proximal ends of the rachis indicating shafts, and the upper end of the frame;

(r) a multiplicity of pinna indicating plates; and, (s) pinna mounting means interconnecting the pinna indicating plates and the rachis indicating shafts, the rachis mounting means comprising a plurality of concentrically mounted cylinders, said cylinders defining a plurality of spaces adapted for nestingly receiving the proximal ends of the rachis indicating shafts.

6. The artificial palm tree of claim 5 wherein the leaf scar indicating edge of the helically wound metal strap is inturned.

7. The artificial palm tree of claim 6 wherein the inturned leaf scar indicating edge of helically wound metal strap is melt formed.

8. The artificial palm tree of claim 5 wherein the strap mounting means comprises a fastener selected from the group consisting of heat fusion welds, screws, rivets, staples, nails, blind fasteners, spirally threaded nut and bolt combinations, and adhesive bonds.

9. The artificial palm tree of claim 8 wherein the frame comprises a plurality of longitudinally extending shafts, and a plurality of laterally extending braces, the laterally extending braces spanning between and interconnecting the longitudinally extending shafts.

10. The artificial palm tree of claim 9 wherein the helically wound metal strap comprises a plurality of strap segments.

11. The artificial palm tree of claim 10 wherein the pinna mounting means comprises a fastener selected from the group consisting of heat fusion welds, slip sleeve and slip pin combinations, spirally threaded lug and aperture combinations, whole formed joints, adhesive bonds, rivets, screws, staples, and spirally threaded nut and bolt combinations.

* * * * *